US010135137B2

(12) United States Patent
Rao et al.

(10) Patent No.: US 10,135,137 B2
(45) Date of Patent: Nov. 20, 2018

(54) LOW COST SPACE-FED RECONFIGURABLE PHASED ARRAY FOR SPACECRAFT AND AIRCRAFT APPLICATIONS

(71) Applicant: NORTHROP GRUMMAN SYSTEMS CORPORATION, Falls Church, VA (US)

(72) Inventors: Sudhakar K. Rao, Rancho Palos Verdes, CA (US); Arun K. Bhattacharyya, Littleton, CO (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 306 days.

(21) Appl. No.: 14/627,053

(22) Filed: Feb. 20, 2015

(65) Prior Publication Data

US 2016/0248157 A1 Aug. 25, 2016

(51) Int. Cl.
*H01Q 1/28* (2006.01)
*H01Q 3/26* (2006.01)
(Continued)

(52) U.S. Cl.
CPC ..... *H01Q 3/2694* (2013.01); *H01Q 1/28* (2013.01); *H01Q 21/0018* (2013.01); *H01Q 13/0258* (2013.01)

(58) Field of Classification Search
CPC .... H01Q 3/2694; H01Q 21/0018; H01Q 1/28; H01Q 13/0258
(Continued)

(56) References Cited

U.S. PATENT DOCUMENTS 4,044,360 A * 8/1977 Wolfson ..... H01P 1/185 333/238
4,799,065 A 1/1989 Thompson
(Continued)

FOREIGN PATENT DOCUMENTS

EP 1693922 A1 * 8/2006 ..... H01Q 3/26
EP 2221919 A1 * 8/2010 ..... H01Q 3/46

OTHER PUBLICATIONS

Caekenberghe, Koen Van, et al. "An Analog RF MEMS Slotline True-Time-Delay Phase Shifter", IEEE Transactions on Microwave Theory and Techniques, IEEE 2008, pp. 1-9.
(Continued)

*Primary Examiner* — Vladimir Magloire
*Assistant Examiner* — Nuzhat Pervin
(74) *Attorney, Agent, or Firm* — John A. Miller; Shumaker, Loop & Kendrick, LLP

(57) ABSTRACT

A phased array antenna system including a front-end circuit having a plurality of antenna channels, each including a front antenna element and a rear antenna element, that provides a spatially combined beam. Each antenna channel includes a beam scan phase shifter and a true time delay phase shifter through which the receive signals or the transmit signals propagate. The system further includes a back-end circuit spaced from the front-end circuit and including an antenna receiving the receive signals from the rear elements or transmitting the transmit signals to the rear elements. The back-end circuit further includes an ortho-mode transducer that separates the transmit signal or the receive signal into orthogonally polarized signals, and a pair of couplers and a pair of polarization phase shifters that combine to adjust the polarization of the transmit signal or the receive signal. The spatially combined beam is reconfigurable in beam shape and its location.

14 Claims, 3 Drawing Sheets

(51) Int. Cl.
*H01Q 13/02* (2006.01)
*H01Q 21/00* (2006.01)

(58) Field of Classification Search
USPC ..... 342/371
See application file for complete search history.

(56) References Cited

U.S. PATENT DOCUMENTS 5,014,023 A * 5/1991 Mantele ..... H03H 7/20 333/161
6,323,815 B1 11/2001 Rao et al.
6,380,908 B1 4/2002 Andrews et al.
6,393,177 B2 5/2002 Paek
6,421,021 B1 * 7/2002 Rupp ..... H01Q 13/085 343/753
6,456,252 B1 9/2002 Goyette
6,646,599 B1 11/2003 Apa et al.
6,807,343 B2 10/2004 Tulchinsky et al.
7,009,560 B1 * 3/2006 Lam ..... H01Q 3/2682 342/374
7,098,859 B2 8/2006 Shimawaki et al.
7,307,596 B1 12/2007 West
7,453,413 B2 11/2008 Larry et al.
7,570,133 B1 8/2009 Taft et al.
8,350,776 B1 1/2013 Bauman
8,358,249 B2 * 1/2013 Toso ..... H01Q 3/46 343/753
8,693,970 B2 4/2014 Corman et al.
2006/0097940 A1 * 5/2006 Shimawaki ..... H01Q 3/26 343/761
2006/0125687 A1 6/2006 Greeley
2006/0291537 A1 * 12/2006 Fullerton ..... G01S 7/4052 375/145
2008/0151967 A1 * 6/2008 Fullerton ..... G01S 7/4052 375/145
2010/0207833 A1 * 8/2010 Toso ..... H01Q 3/46 343/754
2010/0283703 A1 11/2010 Chen
2011/0111751 A1 * 5/2011 Markhovsky ..... G01S 3/74 455/423
2011/0122026 A1 5/2011 DeLaquil et al.
2011/0256882 A1 * 10/2011 Markhovsky ..... G01S 3/74 455/456.1
2011/0286508 A1 * 11/2011 Smith ..... H04L 25/03343 375/224
2012/0155515 A1 * 6/2012 Smith ..... H04L 25/03343 375/219
2013/0023285 A1 * 1/2013 Markhovsky ..... G01S 3/74 455/456.1
2013/0045754 A1 * 2/2013 Markhovsky ..... G01S 3/74 455/456.1
2013/0147664 A1 6/2013 Lin

OTHER PUBLICATIONS

Caekenberghe, Koen Van, "RF MEMS Technology for Radar Sensors", The Netherlands, 6 pgs.

* cited by examiner

LOW COST SPACE-FED RECONFIGURABLE PHASED ARRAY FOR SPACECRAFT AND AIRCRAFT APPLICATIONS

BACKGROUND

Field

This invention relates generally to a phased array antenna and, more particularly, to a phased array antenna for spacecraft and aircraft applications that uses a spatial combining technique employing beam scan phase shifters and true-time delay phase shifters so as to eliminate the need for a beam-forming network and intermediate frequency (IF) hardware and providing polarization control.

Discussion

Phased array antennas are well known in the art for many applications, where most phased array antennas include many antenna elements, such as 400 elements. The phase of each of the signals from a particular source that are received by the antenna elements are selectively controlled so that all of the signals are in phase with each at a common antenna port, which allows the antenna to be narrowly directed to the source with high gain. Typically, phased array antennas include beam-forming networks that weight the individual signals so as to adjust their amplitude and phase so that they can be coherently added together in this manner. Further, at relatively high frequencies, such as 40 GHz and above, beam-forming networks are not available and as such the received analog signals must be down-converted to an intermediate frequency signal before being sent to the beam-forming network, which requires significant hardware in each channel for the separate antenna elements. Also, known phased array antennas have limited flexibility because they are designed for a particular polarization. Thus, for space-borne applications, once the phased array antenna is launched on a satellite or spacecraft, it is not possible to change the polarization scheme for various types of communications signals.

DETAILED DESCRIPTION OF THE EMBODIMENTS

The following discussion of the embodiments of the invention directed to a space-fed reconfigurable phased array antenna that does not require a beam-forming network and intermediate frequency down-conversion hardware is merely exemplary in nature, and is in no way intended to limit the invention or its applications or uses. For example, the phased array antenna of the invention has particular application for a spacecraft. However, as will be appreciated by those skilled in the art, the phased array antenna of the invention will have application for aircraft and ground applications.

As will be discussed in detail below, the present invention proposes a space-fed reconfigurable phased array (SRPA) antenna system that has a reduced cost and complexity over known phased array antennas because it eliminates the need for bulky, heavy and complex beam-forming networks and associated conversion electronics for converting high frequency signals to intermediate frequency signals. As will be discussed in detail below, the proposed SRPA antenna system uses a spatial signal combining technique to replace the beam-forming network that employs a combination of beams scan phase shifters and true time delay (TTD) phase shifters for beam scanning and beam shaping reconfigurablity. The spatial signal combining technique also allows use of any suitable polarization, such as vertical polarization (VP), horizontal polarization (HP), right hand circular polarization (RHCP), left hand circular polarization (LHCP), elliptical polarization, diagonal polarization, etc. The spatially combined beam is reconfigurable in beam shape and its location.

Figure 1:
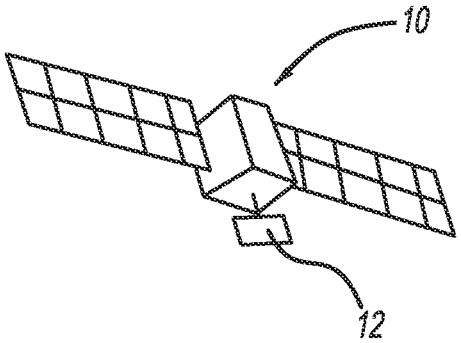
FIG. 1 is an illustration of a satellite including a space-fed reconfigurable phased array antenna.

FIG. 1 is an isometric view of a satellite 10 including an SRPA antenna system 12 of the type referred to above showing a space-borne application of such an array antenna. The satellite 10 is intended to represent any airborne or space-borne platform.

Figure 2:
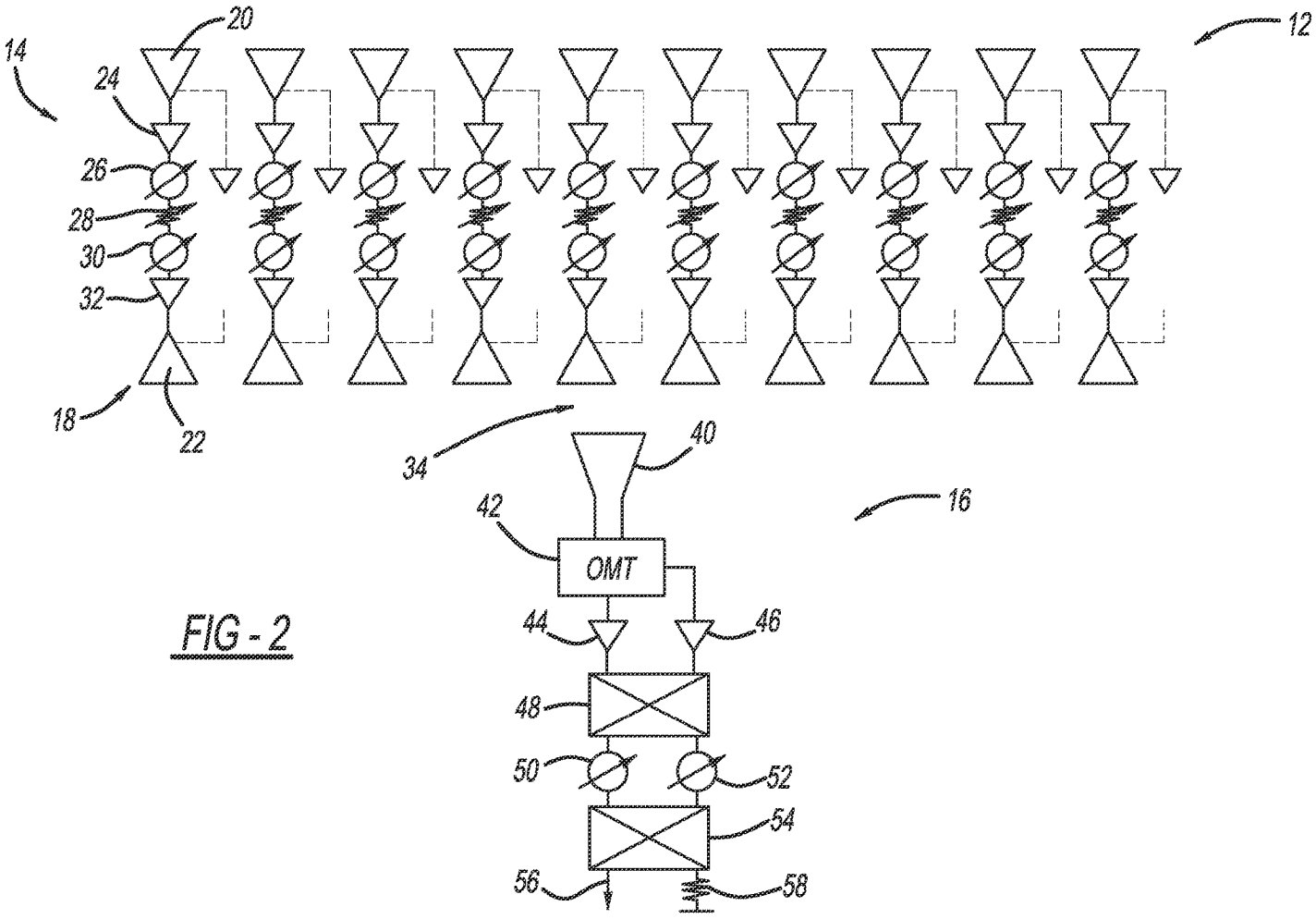
FIG. 2 is a schematic diagram of the space-fed reconfigurable phased array antenna.

FIG. 2 is a schematic diagram of the SRPA antenna system 12 separated from the satellite 10. The system 12 will be discussed below as being in a receive mode that receives up-link signals from the ground or signals from other satellites, spacecraft or aircraft. However, those skilled in the art will understand that the system 12 can also be configured for transmitting signals. The antenna system 12 includes a front-end circuit 14 and a back-end circuit 16 separated by an open space 34 for the spatial combining as will become apparent from the discussion below. The front-end circuit 14 includes a number of antenna channels 18, ten of which are shown in this non-limiting example, each including a receive antenna element 20 and a transmit antenna element 22, where the number of the channels 18 in the system 12 is determined for a particular application based on signal gain, performance, etc., and may be upwards of 400 channels. The antenna elements 20 and 22 can be any suitable antenna, such as feed horns, ring-slot elements, stacked patches, flared notch elements, ridged waveguide elements, bow-tie elements, planar antenna elements, etc.

When a signal from a particular source (not shown) is received by the receive antenna elements 20 in the system 12 from a particular direction, they will all be out of phase with each other, and thus need to be phase shifted to be put in phase to get the desired signal gain and directivity. The signal received in each of the channels 18 is first amplified by a low noise amplifier (LNA) 24 and adjusted in phase by a beam scan phase shifter 26. The phase shifters 26 can be, for example, modular $2\pi$ phase shifters and provide phase alignment of the signals received by the antenna elements 20 from the point source, such as a source on the ground. The phase shifted and amplified signal in each channel 18 is then attenuated by an attenuator 28 and sent to a TTD phase shifter 30. As is well understood by those skilled in the art, a true time delay device is a signal line having a certain length, where signals propagating along the device are delayed by the length of the device. The TTD phase shifters 30 can be any suitable signal propagation device having the desired length on which the signal propagates so that the length of the device determines the phase of the signal at the output of the device.

The signal losses caused by the phase shifters 26 and 30 and the attenuator 28 can be returned to provide increased gain by an amplifier 32, where the signal in each channel 18 is then transmitted by the transmit antenna element 22 into the open space 34 between the circuits 14 and 16. The TTD phase shifters 30 provide the phase alignment of the signals transmitted by the transmitter antenna elements 22 across the open space 34, so that they are in phase with each other when received by the circuit 16. The TTD phase shifters 30 are necessary because a more significant degree of phase change may occur from the antenna elements 22 to the circuit 16, which cannot be corrected by a modular 2π phase shifter, namely, the phase shifters 24. Thus, the phase shifters 24 provide the directionality to which the antenna system 12 is directed to receive the signals and the TTD phase shifters 30 are selectively set depending on the desired wavelength of the signal being received and the distance between the front-end circuit 14 and the back-end circuit 16. Further, by controlling the variable attenuators 28 in different manners for the channels 18, the size of the beam can be adjusted, where some of the elements 20 and 22 may be removed from the array 14 based on the attenuation of the signal.

All of the signals transmitted by the transmit antenna elements 22 travel across the open space 34 and are received by an antenna horn 40 in the back-end circuit 16. The signals from each channel 18 have been adjusted in phase to provide spatial signal combining such that all of the signals are in phase when they are received by the horn 40. The combined in-phase signal is then sent to an ortho-mode transducer (OMT) 42, whose operation is well known to those skilled in the art, that separates the signal into two separate polarizations, such as vertical polarization and horizontal polarization, which is required to create a circularly polarized signal. The two orthogonally polarized signals from the OMT 42 are amplified in separate lines by amplifiers 44 and 46 and are provided to a coupler 48 that couples the two separately polarized signals together to provide a circularly polarized signal, where the coupler 48 can selectively provide different power levels at its output ports. The circularly polarized signals at the output ports of the coupler 48 are then sent to separate phase shifters 50 and 52, such as modular 2π phase shifters, to change the orientation of the polarization of the signals, if desired. The corrected signals from the phase shifters 50 and 52 are then provided to a second coupler 54 that combines the signals to provide the desired polarization at an output port 56, where a second output port 58 of the coupler 54 is not used. Thus, the combination of the couplers 48 and 54 and the phase shifters 50 and 52 allow flexible polarization so that once the antenna system 12 has been launched on the satellite 10, the polarization scheme can be changed for a different application, such as, for example, to left hand circular polarization or right hand circular polarization.

Figure 3:
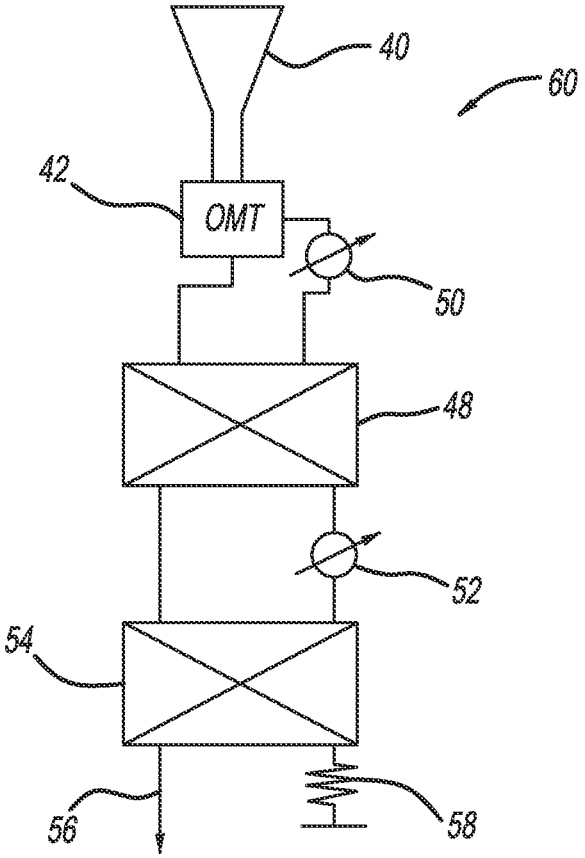
FIG. 3 is a schematic diagram of an alternate back-end circuit for use in the reconfigurable phased array antenna shown in FIG. 2.

The configuration of the couplers 48 and 54 and the phase shifters 50 and 52 in the back-end circuit 16 is one way to provide the flexible polarization as discussed. FIG. 3 is a schematic diagram of a back-end circuit 60 that is similar to the back-end circuit 16 showing another way, where like elements are identified by the same reference number. In this embodiment, the amplifiers 44 and 46 have been eliminated and one of the outputs of the OMT 42 includes the phase shifter 52 instead of the output of the coupler 50. By phase shifting one of the inputs to the coupler 48 and one of the outputs from the coupler 48 in this manner, the flexible polarization can be achieved in the same manner as discussed above for the back-end circuit 16.

TABLE 1 below provides examples of the flexible polarizations for both of the back-end circuits 16 and 60, where Ph1 is the output phase of the phase shifter 50 and Ph2 is the output phase of the phase shifter 52.

TABLE 1

| # | Ph1 | Ph2 | Pol |
|---|---|---|---|
| 1 | 0 | 0 | Y-pol |
| 2 | 90 | 0 | D-pol (45 deg) |
| 3 | 0 | 90 | y-pol |
| 4 | 90 | 90 | LHCP |
| 5 | 90 | −90 | RHCP |
| 6 | −90 | −90 | LHCP |
| 7 | 0 | −90 | Y-pol |
| 8 | −90 | 0 | D-pol (135 deg) |
| 9 | 180 | 0 | X-pol |
| 10 | −90 | 90 | RHCP |

Figure 4:
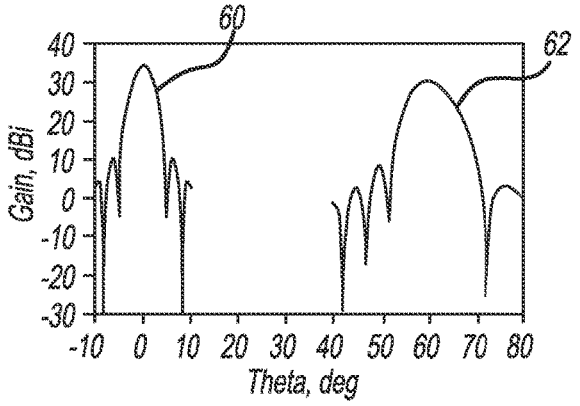
FIG. 4 is a graph with degrees on the horizontal axis and gain on the vertical axis showing beam patterns for a 0° scan and 60° scan of a 1045 element phase array antenna with a 10 dB amplitude taper across the array.
Figure 5:
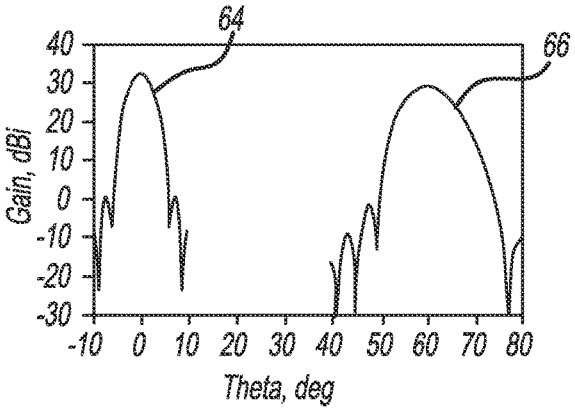
FIG. 5 is a graph with degrees on the horizontal axis and gain on the vertical axis showing beam patterns for a 0° scan and 60° scan of a 1045 element phase array antenna with a 25 dB amplitude taper across the array.

To further show performance of a phased array antenna as discussed above, FIG. 4 is a graph with degrees on the horizontal axis and gain on the vertical axis showing two beam patterns for a 1045 element phased array antenna having a 10 dB amplitude taper illustrating beam scan and side-lobe reconfigurability, where plot 64 illustrates a 0° scan and plot 66 illustrates a 60° scan of the antenna. FIG. 5 is a graph with degrees on the horizontal axis and gain on the vertical axis showing two beam patterns for a 1045 element phased array antenna having a 25 dB amplitude taper illustrating beam scan and side-lobe reconfigurability, where plot 64 illustrates a 0° scan and plot 66 illustrates a 60° scan of the antenna. The low side-lobes in the plots 60 and 62 are on the order of −30 dB.

Figure 6:
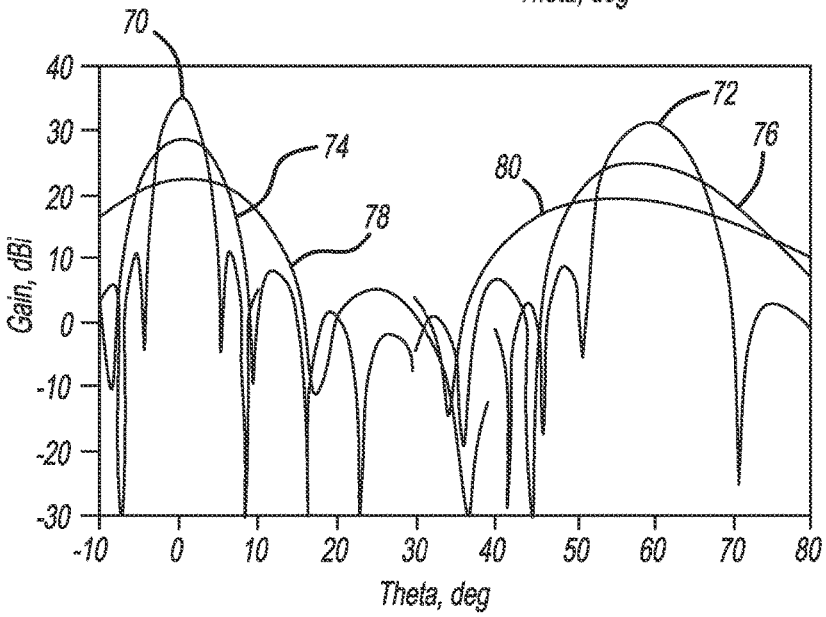
FIG. 6 is a graph with degrees on the horizontal axis and gain on the vertical axis showing beam broadening patterns for a 0° scan and 60° scan of a 1045 element, a 253 element and a 61 element phased array antenna.

FIG. 6 is a graph with degrees on the horizontal axis and gain on the vertical axis showing several beam patterns depicting beam shape reconfigurability and beam broadening of a phased array antenna having a 10 dB taper, where plot 70 illustrates a 0° scan for a 1045 element array, plot 72 illustrates a 60° scan for a 1045 element array, plot 74 illustrates a 0° scan for 253 element array, plot 76 illustrates a 60° scan for a 253 element array, plot 78 illustrates a 0° scan for a 61 element array, and plot 80 illustrates a 60° scan for a 61 element array. The number of elements that are switched on at any particular point in time is controlled through variable attenuators at low level.

The discussion above of the antenna system 12 refers to signals received from the ground or other airborne platforms. However, as will be appreciated by those skilled in the art, the antenna system 12 can also be used in a transmit mode where signals to be transmitted are provided on the line 56 and coupled into the front-end circuit 14 to be transmitted by the antenna elements 20 in phase to a specific direction. In this embodiment, the amplifiers 24 will likely be high power amplifiers for the transmit application.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A phased array antenna system comprising:

a front-end circuit including a plurality of antenna channels where each antenna channel includes a front antenna element and a rear antenna element, said front antenna element being operable to receive signals from the environment or transmit signals into the environment, each antenna channel further including a beam scan phase shifter and a true time delay (TTD) phase shifter through which the receive signals or the transmit signals propagate, a variable attenuator positioned between the beam scan phase shifter and the TTD phase shifter that provides signal attenuation, and an amplifier positioned between the beam scan phase shifter and the front antenna element that is a low noise amplifier for the receive signals from the environment or a high power amplifier for transmitting signals into the environment; and a back-end circuit spaced apart from the front-end circuit and including a single antenna receiving the receive signals from all of the rear antenna elements or transmitting the transmit signals to all of the rear antenna elements, said back-end circuit further including an ortho-mode transducer that separates the transmit signals or the receive signals into orthogonally polarized signals, said back-end circuit further including a pair of couplers and a pair of polarization phase shifters that combine to adjust the polarization of the transmit signals or the receive signals.

2. The antenna system according to claim 1 wherein the pair of couplers include a first coupler and a second coupler, and wherein the ortho-mode transducer includes a first output coupled to a first input of the first coupler and a second output coupled to a second input of the first coupler, and wherein a first output of the first coupler is coupled to a first input of the second coupler and a second output of the first coupler is coupled to a second input of the second coupler.

3. The antenna system according to claim 2 wherein the pair of phase shifters include a first phase shifter provided between the first output of the first coupler and the first input of the second coupler and a second phase shifter provided between the second output of the first coupler and the second input of the second coupler.

4. The antenna system according to claim 2 wherein the pair of phase shifters include a first phase shifter provided between the second output of the ortho-mode transducer and the second input of the first coupler and a second phase shifter provided between the second output of the first coupler and the second input of the second coupler.

5. The antenna system according to claim 1 wherein the antenna system is configured to be provided on a spacecraft or an aircraft.

6. The antenna system according to claim 1 wherein the front antenna elements and the rear antenna elements are selected from the group consisting of antenna horns, ring-slot elements, stacked patch elements, flared notch elements, ridged waveguide elements and bow-tie elements.

7. The antenna system according to claim 1 wherein the beam scan phase shifters and the polarization phase shifters are modular $2\pi$ phase shifters.

8. The antenna system according to claim 1 wherein the antenna in the back-end circuit is a feed horn.

9. A phased array antenna system for a space-borne platform, said system comprising:

a front-end circuit including a plurality of antenna channels where each antenna channel includes a front antenna element and a rear antenna element, said front antenna element being operable to receive signals from the environment or transmit signals into the environment, each antenna channel further including a beam scan phase shifter and a true time delay (TTD) phase shifter through which the receive signals or the transmit signals propagate, a variable attenuator positioned between the beam scan phase shifter and the TTD phase shifter that provides signal attenuation, and an amplifier positioned between the beam scan phase shifter and the front antenna element that is a low noise amplifier for the receive signals from the environment or a high power amplifier for transmitting signals into the environment; and a back-end circuit spaced apart from the front-end circuit and including a single feed horn receiving the receive signals from all of the rear antenna elements or transmitting the transmit signals to all of the rear antenna elements, said back-end circuit further including an ortho-mode transducer that separates the transmit signals or the receive signals into orthogonally polarized signals, and a first coupler and a second coupler, wherein the ortho-mode transducer includes a first output coupled to a first input of the first coupler and a second output coupled to a second input of the first coupler, and wherein a first output of the first coupler is coupled to a first input of the second coupler and a second output of the first coupler is coupled to a second input of the second coupler, said back-end circuit further including a first polarization phase shifter provided between the first output of the first coupler and the first input of the second coupler and a second polarization phase shifter provided between the second output of the first coupler and the second input of the second coupler, where the signals are reconfigurable in beam shape and location.

10. The antenna system according to claim 9 wherein the front antenna elements and the rear antenna elements are selected from the group consisting of antenna horns, ring-slot elements, stacked patch elements, flared notch elements, ridged waveguide elements and bow-tie elements.

11. The antenna system according to claim 9 wherein the beam scan phase shifters and the polarization phase shifters are modular $2\pi$ phase shifters.

12. A phased array antenna system for a space-borne platform, said system comprising:

a front-end circuit including a plurality of antenna channels where each antenna channel includes a front antenna element and a rear antenna element, said front antenna element being operable to receive signals from the environment or transmit signals into the environment, each antenna channel further including a beam scan phase shifter and a true time delay (TTD) phase shifter through which the receive signals or the transmit signals propagate, a variable attenuator positioned between the beam scan phase shifter and the TTD phase shifter that provides signal attenuation, and an amplifier positioned between the beam scan phase shifter and the front antenna element that is a low noise amplifier for the receive signals from the environment or a high power amplifier for transmitting signals into the environment; and a back-end circuit spaced apart from the front-end circuit and including a single feed horn receiving the receive signals from all of the rear antenna elements or transmitting the transmit signals to all of the rear antenna elements, said back-end circuit further including an ortho-mode transducer that separates the transmit signals or the receive signals into orthogonally polarized signals, and a first coupler and a second coupler, wherein the ortho-mode transducer includes a first output coupled to a first input of the first coupler and a second output coupled to a second input of the first coupler, and wherein a first output of the first coupler is coupled to a first input of the second coupler and a second output of the first coupler is coupled to a second input of the second coupler, said back-end circuit further including a first polarization phase shifter provided between the second output of the ortho-mode transducer and the second input of the first coupler and a second polarization phase shifter provided between the second output of the first coupler and the second input of the second coupler.

13. The antenna system according to claim 12 wherein the front antenna elements and the rear antenna elements are selected from the group consisting of antenna horns, ring-slot elements, stacked patch elements, flared notch elements, ridged waveguide elements and bow-tie elements.

14. The antenna system according to claim 12 wherein the beam scan phase shifters and the polarization phase shifters are modular $2\pi$ phase shifters.

* * * * *